United States Patent [19]

Löffler

[11] 4,374,448

[45] Feb. 22, 1983

[54] WEB TAKE-OFF ROLLER ASSEMBLY

[76] Inventor: Walter Löffler, Schulstrasse 6, 7265 Neubulach 5, Fed. Rep. of Germany

[21] Appl. No.: 190,564

[22] Filed: Sep. 25, 1980

[30] Foreign Application Priority Data

Sep. 29, 1979 [DE] Fed. Rep. of Germany ..... 2939693

[51] Int. Cl.[3] ..... D01G 15/46

[52] U.S. Cl. ..... 19/106 R

[58] Field of Search ..... 19/98, 106 R

[56] References Cited

U.S. PATENT DOCUMENTS 3,364,527 1/1968 Ramo ..... 19/106 R
4,221,022 9/1980 Iida ..... 19/106 R

FOREIGN PATENT DOCUMENTS 955777 4/1964 United Kingdom ..... 19/106 R
961511 6/1964 United Kingdom ..... 19/106 R
976856 12/1964 United Kingdom ..... 19/106 R

*Primary Examiner*—Louis Rimrodt
*Attorney, Agent, or Firm*—Townsend and Townsend

[57] ABSTRACT

In a web take-off roller assembly for carding machines, a plurality of cooperating rollers are provided and are mounted at each side in first and second lateral members or side plates. One of the rollers, the take-off roller, is mounted in the first lateral members, which is adapted to be fixed to the frame of the carding machine, whereas all the remaining rollers are mounted in the second lateral members, which members are adapted to be pivoted or rotated around an axis which coincides with the axis of the shaft of the take-off roller. By this, the relative position of the remaining rollers may be adjusted with respect to the take-off roller.

5 Claims, 4 Drawing Figures

WEB TAKE-OFF ROLLER ASSEMBLY

BACKGROUND OF THE INVENTION

The invention relates to a web take-off roller assembly for carding machines, comprising a take-off roller, two guide rollers, one of which cooperates with the take-off roller, and optionally auxiliary rollers which cooperate with the take-off roller, all these rollers being mounted in lateral or side members.

It is an object of the invention to improve a web take-off roller assembly of the aforementioned kind such that it may be fitted to different types of carding machines without any need for modification.

BRIEF SUMMARY OF THE INVENTION

According to the invention, this object is achieved in that the take-off roller on the one hand and all the other rollers on the other hand are mounted in first and second lateral members, respectively, and in that the second lateral members carrying the other rollers are adapted to be pivotally adjustable around an axis which coincides with the axis of the shaft of the take-off roller.

The pivotal or second lateral members are preferably each carried by the associated adjoining first lateral member.

In one particular embodiment, the pivotally mounted second lateral members each comprise a cylindrical boss which is provided with a centered bore adapted to receive the shaft of the take-off roller, the boss being rotatably received in a corresponding bore in the associated first lateral member.

In order to lock said adjoining first and second lateral members with one another, one of the associated first and second lateral members is provided with at least one arcuate longitudinal slot through which a locking screw extends into the adjoining lateral member.

The pivotal or second lateral members may be additionally provided with adjustable bearings for at least one of the rollers mounted therein.

DESCRIPTION OF THE DRAWINGS

A preferred embodiment of the invention is disclosed in detail in the following description with reference to the accompanying drawings, wherein.

DETAILED DESCRIPTION

Figure 1:
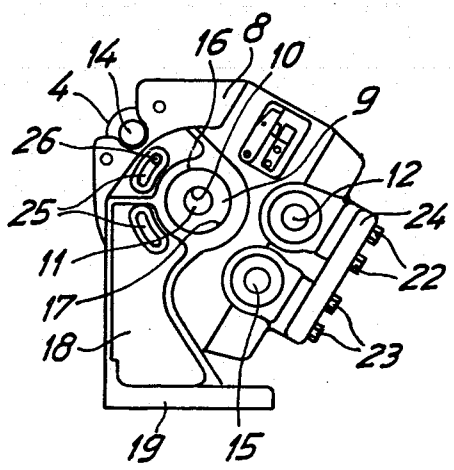
FIG. 1 is a side elevation of a web take-off roller assembly.

The web take-off roller assembly illustrated in the drawings comprises a take-off roller 1 which cooperates with an upper guide roller 2, a storage roller 3 and a brush clearing roller 4. A lower guide roller 5 cooperates with the upper guide roller 2, but differs from the upper guide roller 2 in that its circumferential surface is arranged at a distance from the circumferential surface of the take-off roller 1. A web take-off device comprising such a roller assembly is known in the art and, for this reason, is not described in detail hereinafter so far as its function is concerned.

Figure 4:
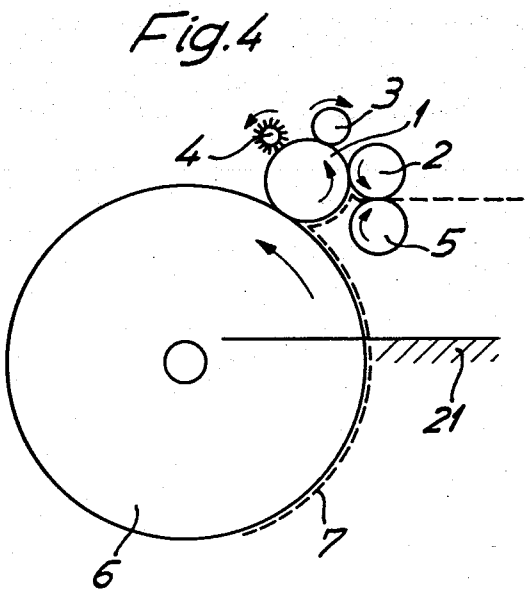
FIG. 4 is a view corresponding to FIG. 3 in which the web take-off roller assembly is fitted to another carding machine.

The take-off roller 1 is situated close to a stripping roller 6 which is not part of the web take-off arrangement, but instead forms the last roller of a carding machine. The directions of rotation of the rollers are indicated by arrows. The fibrous web 7 is transported by the stripping roller 6 along the lower region thereof, as is shown in dashed lines in FIGS. 3 and 4, to the contact region of the take-off roller 1 and the stripping roller 6, at which region it is taken over by the take-off roller 1 and transported to the contacting zone of the take-off roller 1 and the upper guide roller 2 which then removes it from the take-off roller 1 and transports it into the zone of contact between the upper guide roller 2 and the lower guide roller 5, through which it passes and is then further transported in the usual way, for example into cans.

The individual rollers must be in a certain position in relation to one another, to assure a proper operation.

Figure 2:
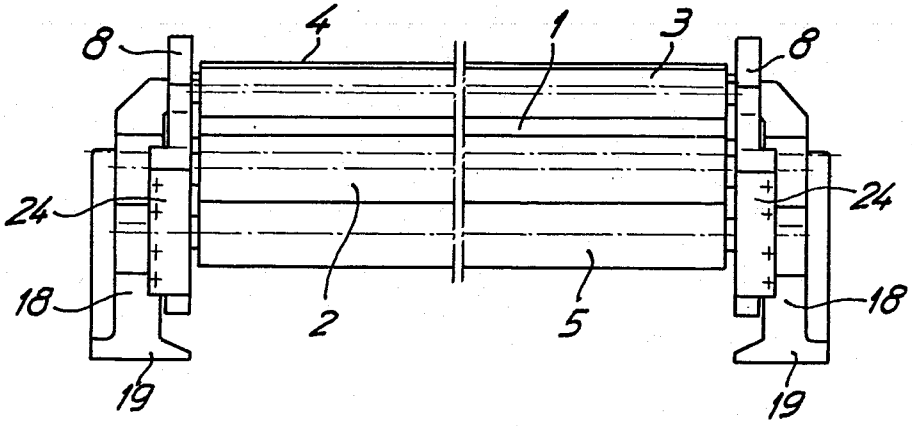
FIG. 2 is a side elevation thereof at right-angles to FIG. 1.

FIGS. 1 and 2 show the mounting of the individual rollers, the shafts thereof being denoted by reference numerals which are higher by 10 with respect to the numerals of the corresponding rollers. As may be seen from FIG. 2, all the rollers of the web take-off roller assembly are mounted on either side in a second lateral member 8 comprising a cylindrical boss 9 with a central bore 10 which receives the shaft 11 of the take-off roller 1. The outer periphery 16 of the boss is mounted for rotation in a corresponding bore 17 in a first or fixed lateral member 18. Accordingly, the second lateral members 8 are pivotal about the axis of the shaft 11.

The fixed lateral member 18 comprises a base 19 adapted to be fixed to the frame of a carding machine.

Figure 3:
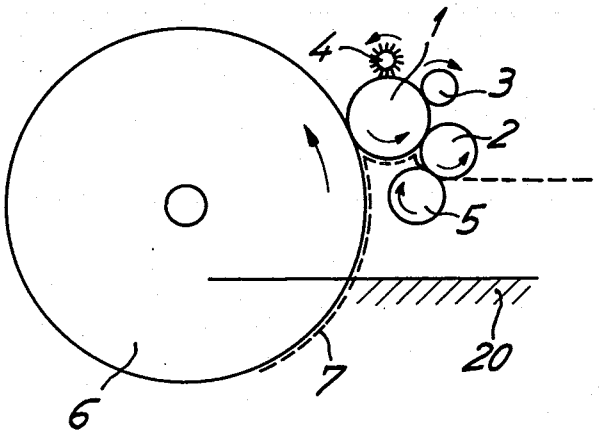
FIG. 3 is a cross-section of the roller assembly and part of a stripping roller of a carding machine.

When the web take-off roller assembly is used for modernising relatively old carding machines, the problem arises that the stripping roller 6 is arranged at different levels in relation to the frame. Nevertheless, it is possible with the web take-off roller assembly described above to individually and optimally adjust the rollers, as may be seen by comparing FIGS. 3 and 4. In FIG. 3, the shaft of the stripping roller 6 is situated above the frame 20, whereas in FIG. 4 the shaft of the stripping roller 6 is situated below the frame 21. To obtain best performance, the lower guide roller 5 must be adjusted to a distance of about 15 mm from the stripping roller 6. This may be achieved by turning the pivotal lateral member 8 counterclockwise in relation to the position shown in FIG. 3. This does not affect the relative positions of the rollers of the web take-off roller assembly.

As may be seen in particular from FIG. 1, the upper guide roller 2 and the lower guide roller 5 are mounted in a bearing flange 24 which may be adjusted in relation to the pivotal lateral member 8 by means of adjusting screws 22 and 23. Alternatively, the guide rollers may even be mounted in separate bearing flanges so that they may be individually adjusted.

The fixed lateral member 18 comprises two arcuate longitudinal slots 25. Locking screws 26 are guided through these slots, being screwed into corresponding bores in the pivotal lateral member 8. It is possible in this way to adjust the angular position of the pivotal lateral member 8 in relation to the associated fixed lateral member 18.

Such a web take-off roller assembly may be easily adapted to existing carding machines, which may thus be modernised with the web take-off roller assembly according to the invention without any need for significant modifications.

I claim:

1. An improved web take-off roller assembly for use with carding machines of the type including a take-off roller adjacent a stripping roller and first and second guide rollers, the first guide roller cooperating with the take-off roller, the improvement comprising:

first mounting means for mounting the guide rollers for rotation about their respective axes; and second mounting means for pivotally mounting said first mounting means and said guide rollers therewith about the axis of the take-off roller so that the guide rollers can be pivoted in unison about the axis of the take-up roller.

2. The improved roller assembly of claim 1 further comprising a frame member means for mounting said first and second mounting means and said take-off roller and guide rollers therewith to the frame of the carding machine.

3. The improved roller assembly of claim 2 wherein:

said second mounting means includes a circular boss having a central bore for receipt of a portion of the take-off roller;

said frame member defines a circular bore; and said boss has a circular outer surface for rotational mating engagement within said circular bore.

4. The improved roller assembly of claim 2 wherein said frame member includes an arcuate slot having its center of curvature generally coincident with the axis of the take-off roller, and further comprising locking members passing through said slots for fixing the relative position of the guide rollers with respect to the take-up roller.

5. The improved roller assembly of claim 1 wherein said first mounting means includes means for adjusting the relative axial positions of said guide rollers with respect to said take-off roller.

* * * * *